United States Patent [19]

Sears

[11] 3,958,486

[45] May 25, 1976

[54] KEYBOARD ATTACHMENTS

[76] Inventor: Gustavus Warren Sears, 11402 Allview Drive, Beltsville, Md. 20705

[22] Filed: Sept. 18, 1974

[21] Appl. No.: 507,370

[52] U.S. Cl. ..... 84/464; 84/478

[51] Int. Cl.[2] ..... A63J 17/00

[58] Field of Search ..... 84/464, 453, 20, 18, 84/25, 105, 107, 108, 111, 113, 169, 470, 477 R, 478, 482

[56] References Cited

UNITED STATES PATENTS

| | | | |
|---|---|---|---|
| 667,541 | 2/1901 | Loring | 84/464 |
| 1,750,988 | 3/1930 | Bostelmann | 84/478 |
| 2,505,608 | 4/1950 | Edwards | 84/470 |
| 3,395,461 | 8/1968 | Krause | 84/478 |
| 3,460,426 | 8/1969 | Jensen | 84/478 |
| 3,785,237 | 1/1974 | Schutze | 84/258 |

*Primary Examiner*—John F. Gonzales

[57] ABSTRACT

This invention relates generally to electrically energizing visual representations of music by means of a portable attachment for the keyboard of pianos and organs; and it has particular application in providing a concept of music that is especially enjoyed by deaf persons, though by no means restricted in that sense.

4 Claims, 8 Drawing Figures

A
A
H. Warren Sears

H. Warren Sears

KEYBOARD ATTACHMENTS

CROSS REFERENCES OF RELATED U.S. PAT. NOS.

| | | |
|---|---|---|
| 667,541 1901 | Loring | 84-464 |
| 1,566,202 1925 | Giller | 84-464 |
| 1,750,988 1930 | Bostelman | 84-478 |
| 2,505,608 1950 | Edwards | 84-470 |
| 3,395,461 1968 | Krause | 84-478 |

BRIEF SUMMARY OF THE INVENTION

This invention will provide an improved means to produce visible music. The inventor's preferred embodiment is based upon an aesthetic principle which has long been recognized in the art: twelve spectrum-colored lights in rainbow sequence coordinated to twelve musical tones of the chromatic scale within one octave.

To produce this kind of music, two basic units are needed: one - a cabinet to display or project a series of colored lights; and two - a switching device for electrically energizing the colored light unit in coordination with the musical instrument. The claims in this invention relate to improvements in the switching device.

More specifically stated, this invention is a portable electric switching device that adapts to a portion of a piano or organ keyboard. The device contains a plurality of switches that are activated by vertical plungers that adapt to the top of the piano keys to move individually as the piano is played, thus completely under control of the performer. This switching apparatus is connected by cable to electrically energize a light instrument, such as the one shown in FIG. 5, or, it may be connected to other related units that have been developed previously or will be developed in the future.

OBJECTIVES OF THE INVENTION

Many uses and purposes for this invention are envisioned. Since means are provided for one to actually see melody lines, rhythm patterns and harmonic structure, it's usefulness may extend to homes, churches, schools and theaters for the deaf - giving satisfaction to both performer and audience - not only as a solo instrument, but as accompaniment for singing in the sign language as well. Also, the synchronization of visual stimuli with sound adds greatly to the pleasure and understanding of audible music for hearing persons. Therefore, in order for as many people as possible to benefit, a real object of this invention is to disclose a simplicity of design that is more workable yet lower in cost than anything similar that is now available.

Another object is to provide a teaching aid that will stimulate both pupil and teacher to quicker understanding of music theory and composition.

Another object is to disclose a design for a music-light instrument that is so easy to construct that a "do-it-yourselfer" can assemble it by using a kit from the manufacturer.

Another object is to provide a switching device that is truly portable, so that it can be used by a musician who performs in public, travels from place to place, and must, within a few minutes, connect his own visual instrument, with keyboard adapter, to whatever keyboard instrument is on hand. Although many excellent ideas along these lines have been proposed in the past, there are still several problems which this invention purposes to overcome: the principle problem is that previous designs for keyboard attachments offer no provision for the user to make mechanical adjustments that are needed to accomodate the differences in the height and shape of black keys that are prevalent in pianos and organs of various manufacturers today. Previous designs have vertical adjustment at one level only; but it will be shown by the following that adjustability at two levels is of paramount importance. In the past, all black keys projected a standard ½ inch above the white keys and were shaped straight across the top. However, in today's instruments, some have curved black keys and the relative height of the black keys, at the point of contact with the switch-activating plungers, varies as much as 5/16 inch. (In seventeen models checked, these different measurements were found: 3/16 inch, 7/32 inch, ¼ inch, ⅜ inch, 7/16 inch, ½ inch.) Also, since on some models the distance the key moves at the point of contact is as little as 3/32 inch, the plungers must fit precisely to both the black and white keys. Therefore it is a prime object of this invention to provide a two-level vertical adjustability that will readily adapt to these differences in measurements.

Another object of this invention is to provide means for a mechanically unskilled person to make the aforementioned adjustments without the use of tools or without the need to take anything apart; and to provide transparent windows and indicators to assure accuracy of the adjustments.

The means used to accomplish these objectives will be made clear by the following description:

BRIEF DESCRIPTION

FIG. 1. A perspective of the invention shown in position on a piano keyboard.

FIG. 2. A partial cut-away front and end view of FIG. 1, drawn actual size.

FIG. 2a. A cross-sectional view of FIG. 2 taken on line A—A.

FIG. 3. An adjustment indicator, drawn actual size.

FIG. 4. A Viewing window for observing contact position, drawn actual size.

FIG. 5. The Warren Music*Light. An example of the type of instrument that can be energized with this invention.

FIG. 6. Wiring diagram.

FIG. 7. An enlarged perspective drawing of the contact mechanisms.

DETAILED DESCRIPTION

FIG. 1. EXTERIOR VIEW

Figures 1, 2, 2A, 3, 4, 5:
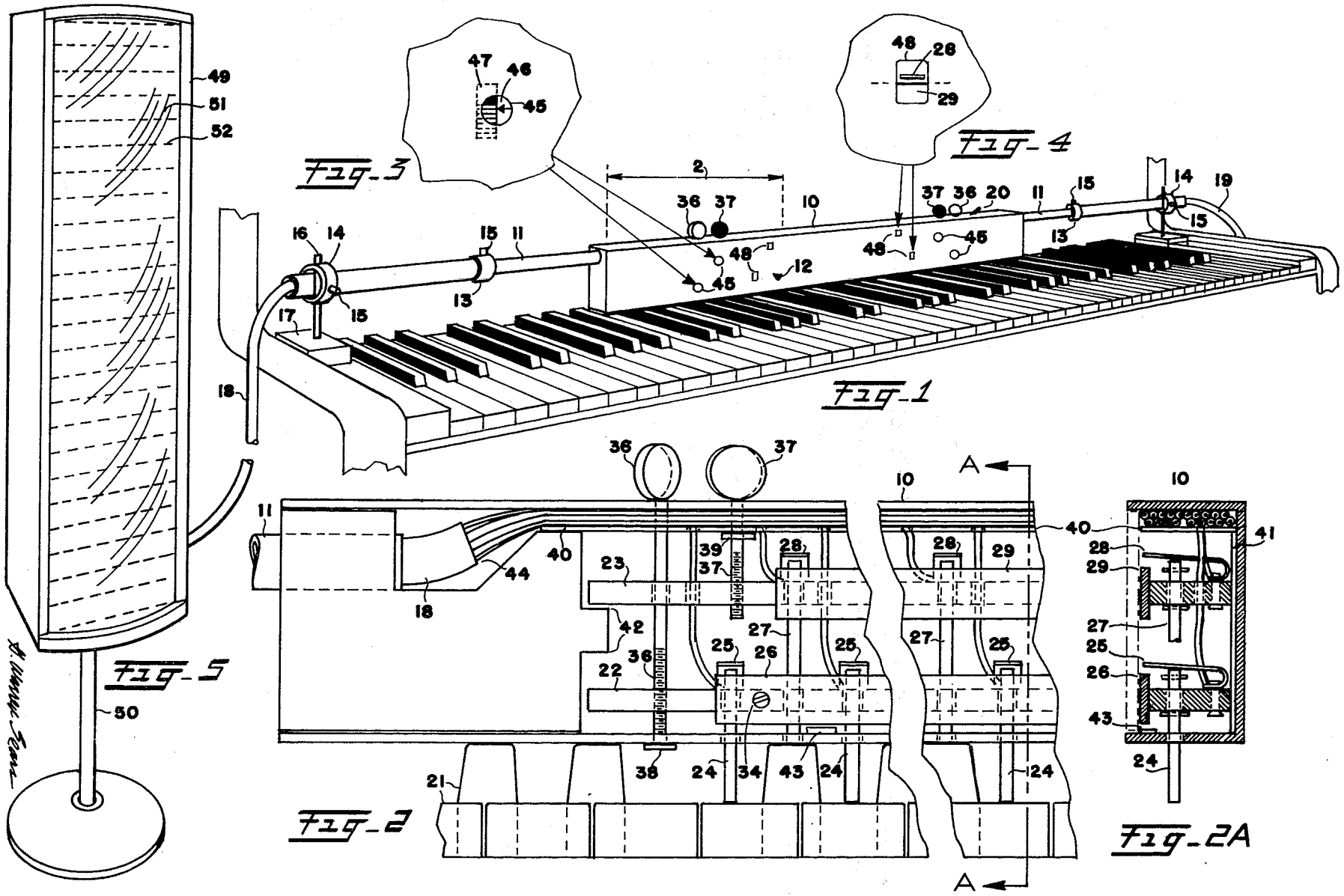

The invention is shown in position on a piano keyboard. The housing 10 is a three sided rectangular channel made of light metal. It is supported by round steel telescoping tubes 11 that are attached to both ends of the housing. These tubes will slidably adjust lengthwise from 38 inches to 54 inches, thereby accomodating everything from a small organ to a fullsize grand piano. Proper position on the keyboard is located by aligning the marker 12 directly above the "middle C" key. The length of the tubings is secured by clamping devices 13, and both the vertical and horizontal positions of the assembly is secured by clamping devices 14. Both clamping devices have knurled-head screws 15 for hand adjustment. The vertical hex-shaped post 16 is seated in a heavy metal base 17 which is covered with rubber on the outerside and bottom to maintain horizontal alignment and prevent marring of the piano. The tubes 11 at left also contain the multi-conductor cable 18 which leads to the instrument described in FIG. 5; the tubes 11 at the right also contain a triple-wire cord 19 including a ground wire, which leads to a footoperated dimmer switch (not shown) and continues to an electrical outlet for a 110 volt A.C. source of power. The dimmer switch, operated by a foot pedal, allows the performer to control light volume to correspond to sound volume. A master toggle switch within the housing - with 'on-off' button 20 easily accessible - gives the performer the immediate option of playing with or without visual effects.

FIG. 2. PARTIAL FRONT CUT-AWAY VIEW, the length of which is indicated by line 2 on FIG. 1 including a section of piano keys 21 illustrated actual size.

Figure 7:
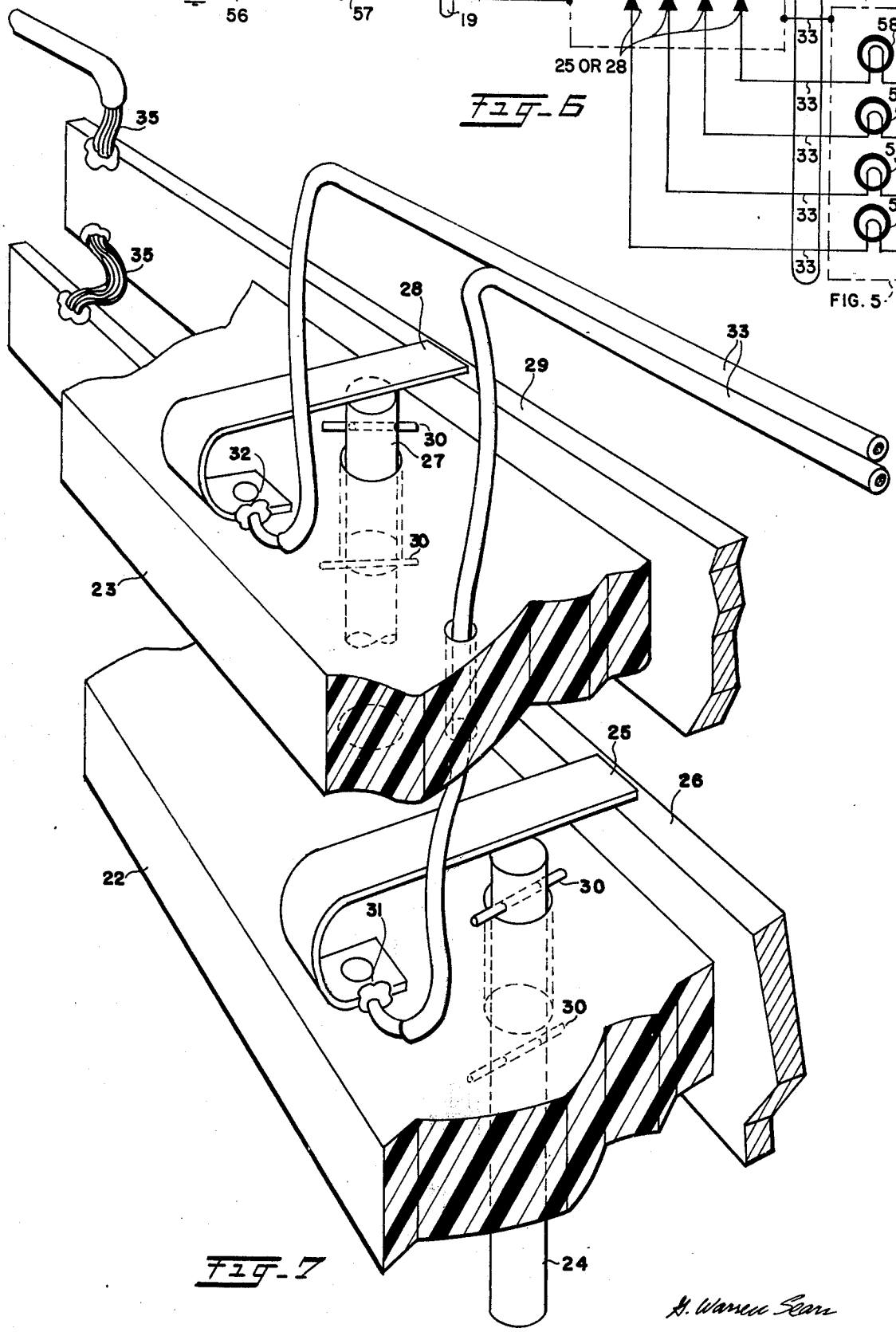

The main purpose of this drawing is to illustrate the principle improvement referred to as 'two-level adjustability', but before the whole unit can be understood it will be helpful to refer to FIG. 7.

FIG. 7. CONTACT MECHANISM - a partial perspective drawing showing component parts.

SUPPORT BLOCKS. Parts 22 and 23 are the lower and upper support blocks - made of non-conductive cloth-impregnated bakelite. The lower block 22 supports all plungers 24, contact strips 25 and the contact bar 26 related to the white keys; and the upper block 23 supports all plungers 27, contact strips 28 and the contact bar 29 related to the black keys.

PLUNGERS are made of transparent, colorless plastic rods. They project slidably through holes in the support blocks and bottom of the housing. The rods are made of plastic for three reasons - safety, appearance and economy - since it is non-conductive, practically invisible on the keyboard, and so lightweight that it operates almost soundlessly and without need for protective rubber or leather tips. At two points on the plunger rods (slightly above and below the related support blocks) small pins 30 serve as positioners and retainers - allowing the plungers to move only a measured distance. The black key plungers necessarily slide through holes in both support blocks, but they are only effected positionally by the upper block.

CONTACT STRIPS. This extremely simple design means real economy in construction and assembly: the contact strips 25, 28 - made of thin flexible berrylium copper - are bent into a shape that offers just enough spring tension to urge them into positive contact with the brass conductor bars 26, 29. At points 31, 32 the contact strips are riveted to the blocks and connected with solder to conductor wires 33.

CONDUCTOR BARS. Two brass bars, secured with screws 34 (FIG. 2) to the support blocks, serve a dual purpose: electrical conductors and structural rigidity. Bar 26, attached to block 22, receives all white key contacts; and bar 29, atached to block 23, receives all black key contacts. Both bars are electrically connected by a flexible wire 35.

OPERATION. By the construction, it will be seen that when the piano key is in the normally at rest position the plunger rod will bear upon it, thereby holding the contact up in open position. When the piano key is depressed, the plunger is released and allows the contact strip to move downward by its own spring tension to make closed contact thereby completing the circuit and energizing the connected visual instrument.

Any number of keys within the two octaves used can be played simultaneously.

FIG. 2. TWO-LEVEL ADJUSTABILITY

It will be seen that each support block - with its associated plungers, contact strips and conductor bar - is a separate unit that fits within the housing and is independently adjustable up and down by means of modified thumbscrews 36, 37. There are two of these screws (one black for black keys, one white for white keys) at each end (FIG. 1), making a total of four. Referring to FIG. 2, the white key adjustment screw 36 is threaded into the lower support block 22, but passes loosely through all other sections. Screw 36 has a retainer piece 38 on the end which bears on the bottom of the housing. The black key screw 37 has a retainer piece 39 which bears on the wire support shelf 40. This screw is threaded into block 23. For easy finger turning, these screws have large disc-shaped heads. Thus it can be seen, by turning these screws the plunger support units are positionally changed to raise or lower the plungers as necessary to fit any keyboard. Shoulders 42 and pads 43 stop the units from moving too high or too low.

Figure 6:
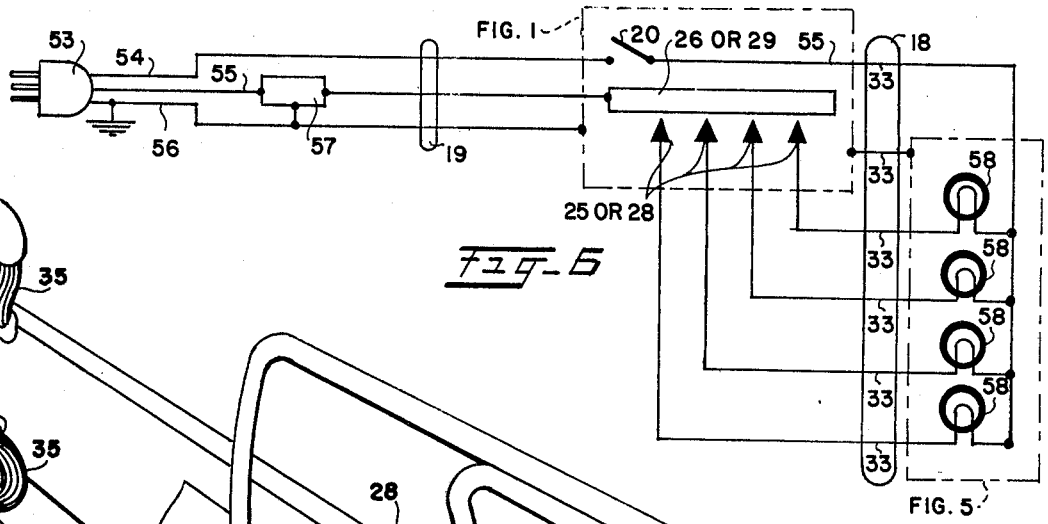

WIRING. The multi-conductor cable 18 passes through the tube into the housing. At point 44 the outer cover is removed and the wires fan out to fit into a rectangular space along the top of the housing where they are supported by a shelf of non-conductive material 40. Each wire passes through a hole in the shelf directly above each connection. Parts 40, 41 FIG. 2*a*, and 43 also serve as insulator shields. See wiring diagram in FIG. 6.

FACE PANEL. The front of the housing (FIG. 1) is made of transparent plastic covered on the inside with opaque paint, but leaving several transparent areas for the purposes described in FIGS. 3 and 4.

FIG. 3. ADJUSTMENT INDICATORS. Drawing is actual size.

There are four of these on the face panel 45 (FIG. 1) - two for white keys and two for black keys. The area within the circle is visible through a transparent area of the face panel. The indicators have two parts which are simply black ink delineations on white paper. The pointer pieces 46, cemented to the inside of the face panel, are stationary. The lined pieces 47, mounted on the front of the support blocks, move up or down as the adjustment screws are turned. These indicators provide means for the user to make accurate adjustments of plunger lengths in two ways: They show the exact distance the support blocks move, and they provide means to keep the blocks parallel by making opposite indicator readings identical.

FIG. 4. CONTACT VIEWING WINDOWS. Drawing is actual size.

This is another device for assisting the user to make accurate adjustments. Four of the actual contacts will be visible through four transparent windows 48 on the face panel thereby allowing the user to see whether contacts are open or closed, thus indicating the need for further adjustment. This drawing shows contact strip 28 in the open position over bar 29. Since all contacts are aligned and fixed positionally relative to the two adjustable units, it can be seen that if the contacts which are visible at both ends are in position to function properly, all others then are in workable position.

FIG. 5 THE VISUAL REPRESENTATION

The inventor's design of a visual display unit is only one example of the type of instrument that can be energized by this invention. This unit is described here to aid in further understanding the visible music concept. Since my claims are only for improvements in the switching device, this description will be brief.

CONSTRUCTION:

A tall narrow cabinet 49 supported by a pedastal base 50. The outermost face panel 51 is made of clear plastic curved for visibility from wide angles and textured to diffuse the edges of light. Behind this panel, a flat sheet of frosted plastic supports individual color-stained plastic filters. In back of this, thin metal sheets 52 are horizontally positioned to separate each light compartment. Light bulbs and fixtures are mounted on the inside of the rear panel. This panel, hinged to the rear of the cabinet, is easily accessible for bulb replacement. The floor stand is threaded at both ends for easy dismantling and moving. The cable, with connector, stores on clamps mounted to the rear panel. The entire unit can be packaged in a kit for assembly by "do-it-yourselfers."

APPEARANCE AND THEORY:

Twenty-four horizontally shaped bands of colored light, comprising two sets of twelve different spectrum colors in rainbow sequence correlate to twenty-four musical tones of a chromatic scale within two octaves. The colors begin at the bottom with violet-red coordinated with the F key on the piano, and continue up the chromatic scale; violet = F#, blue-violet = G, blue = G#, blue-green = A, green = A#, green-yellow = B, yellow = C, yellow-orange = C#, orange = D, orange-red = D#, and ends with red = E. This sequence repeats to make two full octaves - ample range to play the melody line of most popular music. The positioning of the lights in a vertical line which relates to ascending and descending musical tones; and the one-to-one correlation of color-to-tone makes it easy to distinguish one 'note' from another and understand the intelligence of a musical composition. When contiguous lights are lit, the edges of light diffuse and blend together in a way that suggests the audible blend of harmonious sound. Changes in volume of sound can be matched by changes in intensity of light by means of the foot-operated dimmer switch, mentioned previously. Thus, it can be seen, four essential elements of audible music - melody, rhythm, harmony, intensity - can be communicated visibly with this invention.

FIG. 6. WIRING DIAGRAM

Power for operating the invention is obtained from a normal 110 volt outlet through power plug 53.

The black, or hot, wire 54 of the power cable 19, goes through a single pole switch 20 located inside the keyboard attachment (FIG. 1) and continues through a black lead 33 in the multi-conductor cable 18 to terminals common to each of the lights 58 in the display unit (FIG. 5).

Color-coded wires 33 in the multi-conductor cable 18 are connected individually from a light in the display unit to a corresponding contact 25 or 28 in the keyboard unit. As the musical instrument key is depressed, contact strips 25 or 28 make contact with contact bars 26 or 29 (25 mating with 26 and 28 mating with 29).

The white wire 55 in the power cable completes the circuit by its attachment to the end of contact bar 26 or 29 through dimmer unit 57 (a standard commercially available unit) to the power plug.

The green, or ground, wire 56 of the power cable is connected to the cases of the three units: the display unit (FIG. 5), the keyboard unit (FIG. 1), and the dimmer unit 57.

What is claimed:

1. In a visual display device for visually representing the operation of keys on a keyboard musical instrument, a switch means sensing the movement of said keys and controlling the visual representation of that movement by said display device comprising a housing extending across a plurality of keys on said keyboard, said housing having a substantially vertical face panel, means for mounting said housing above the keyboard, a first set of plungers extending from within said housing and resting on the white keys of said keyboard and a second set of plungers extending from within said housing and resting on the black keys of said keyboard, first and second support blocks extending longitudinally within said housing, each of said support blocks being provided with a plurality of apertures for slidably receiving one of said plungers, a first set of contacts being carried by said first support block and a second set of contacts carried by said second support block, said first support block supporting said white key plungers in operative relationship with said first set of contacts such that upon depression of a particular white key a signal is sent to said display for visually representing the depression of said particular white key, said second support block supporting said black key plungers in operative relationship with said second set of contacts such that upon depression of a particular black key a signal is sent to said display for visually representing the depression of said particular black key, and means for adjustably supporting each of said first and second support blocks within said housing.

2. In the visual display device of claim 1, wherein said means for adjustably supporting each of said first and second support blocks comprises a plurality of rotatable screws mounted on said housing.

3. In the visual display device of claim 1, further comprising means for accurately indicating the position of each of said support blocks inside said housing.

4. In the visual display device of claim 3, wherein said indicating means comprises a plurality of transparent windows in the face panel of said housing, index marks secured to the inner surface of said panel and visuable through said windows and indexing lines mounted on said support blocks and visuable through said windows.

* * * * *